US009138068B2

(12) United States Patent
Veronneau

(10) Patent No.: US 9,138,068 B2
(45) Date of Patent: Sep. 22, 2015

(54) CRIB CONVERTIBLE TO A BED, AND KIT AND METHOD FOR CONVERTING THE SAME

(71) Applicant: Groupe Dutailier Inc., Saint-Pie, Quebec (CA)

(72) Inventor: Melissa Veronneau, Saint-Lambert (CA)

(73) Assignee: GROUPE DUTAILIER INC., Saint-Pie, Quebec (CA)

( * ) Notice: Subject to any disclaimer, the term of this patent is extended or adjusted under 35 U.S.C. 154(b) by 395 days.

(21) Appl. No.: 13/623,365

(22) Filed: Sep. 20, 2012

(65) Prior Publication Data

US 2013/0180047 A1 Jul. 18, 2013

Related U.S. Application Data

(60) Provisional application No. 61/585,687, filed on Jan. 12, 2012.

(51) Int. Cl.
*A47D 7/00* (2006.01)
*A47D 11/00* (2006.01)

(52) U.S. Cl.
CPC *A47D 7/00* (2013.01); *A47D 7/005* (2013.01); *A47D 11/005* (2013.01); *Y10T 29/481* (2015.01)

(58) Field of Classification Search
CPC .. A47C 19/005; A47C 19/022; A47D 11/007; A47D 11/005; A47D 7/01; A47D 7/005; A47D 7/00; A47D 11/00
See application file for complete search history.

(56) References Cited

U.S. PATENT DOCUMENTS

| | | | | | |
|---|---|---|---|---|---|
| 74,193 | A | * | 2/1868 | Beurer | 5/174 |
| 855,058 | A | * | 5/1907 | Jamison et al. | 5/53.2 |
| 1,402,607 | A | * | 1/1922 | Hickman | 5/3 |
| 1,442,197 | A | * | 1/1923 | Turner | 297/7 |
| 2,561,637 | A | * | 7/1951 | Rex | 5/99.1 |
| 2,610,332 | A | * | 9/1952 | Field | 5/100 |
| 2,651,057 | A | * | 9/1953 | Power | 5/93.1 |
| 2,672,181 | A | * | 3/1954 | Rose | 297/119 |
| 3,239,270 | A | * | 3/1966 | Milne | 297/118 |
| 3,359,035 | A | * | 12/1967 | Schiffman | 297/317 |
| 3,535,717 | A | * | 10/1970 | Mulder | 5/93.1 |
| 3,727,246 | A | * | 4/1973 | Germano | 5/282.1 |

(Continued)

FOREIGN PATENT DOCUMENTS

| | | |
|---|---|---|
| DE | 198 48 205 | 4/1999 |
| EP | 0 356 277 | 2/1990 |

(Continued)

*Primary Examiner* — David E Sosnowski
*Assistant Examiner* — Eric Kurilla
(74) *Attorney, Agent, or Firm* — Jacobson Holman, PLLC.

(57) ABSTRACT

A crib convertible to a bed, the crib having a length greater than a width of the bed, is provided. The crib includes a crib mattress support board, two longitudinal and two transverse side panels removably attachable one to another in a crib configuration. Each of the crib mattress support board and longitudinal side panels includes a main member having a length less than the length of the crib and at least one extension member removable attached thereto. Upon detachment of the respective at least one extension therefrom, the main member of the crib mattress support board is convertible to a headboard of the bed, while the main member of each longitudinal side panel is convertible to bed mattress support of the bed. A kit for forming one of a crib and a bed, and a method of converting a crib to a bed are also provided.

18 Claims, 11 Drawing Sheets

(56) References Cited

U.S. PATENT DOCUMENTS

| | | | | |
|---|---|---|---|---|
| 4,450,597 | A * | 5/1984 | Hull | 5/2.1 |
| 4,525,883 | A * | 7/1985 | Necowitz | 5/93.2 |
| 4,958,392 | A * | 9/1990 | Cannady | 5/507.1 |
| 5,077,846 | A * | 1/1992 | Wheeler et al. | 5/93.2 |
| 5,146,631 | A * | 9/1992 | Deal | 5/93.2 |
| 5,715,551 | A * | 2/1998 | Proano et al. | 5/93.2 |
| 5,754,993 | A * | 5/1998 | Russell | 5/93.2 |
| 5,790,994 | A | 8/1998 | Leonard | |
| 6,112,347 | A * | 9/2000 | Tharalson et al. | 5/95 |
| 6,817,046 | B1 * | 11/2004 | Srour et al. | 5/99.1 |
| 6,907,627 | B2 * | 6/2005 | Waldman et al. | 5/99.1 |
| 2003/0024045 | A1 * | 2/2003 | Bellows et al. | 5/200.1 |
| 2005/0022302 | A1 | 2/2005 | Johnson | |
| 2008/0184485 | A1 * | 8/2008 | Shamie et al. | 5/2.1 |
| 2008/0263764 | A1 * | 10/2008 | Jones | 5/93.2 |
| 2011/0197795 | A1 * | 8/2011 | Baugh et al. | 108/50.11 |
| 2012/0168328 | A1 * | 7/2012 | Chen | 206/223 |

FOREIGN PATENT DOCUMENTS

| | | |
|---|---|---|
| GB | 2 245 825 | 1/1992 |
| JP | 2000-102452 | 4/2000 |
| WO | WO 2010/026665 | 3/2010 |

* cited by examiner

CRIB CONVERTIBLE TO A BED, AND KIT AND METHOD FOR CONVERTING THE SAME

FIELD OF THE INVENTION

The present invention relates to convertible bed furniture, and more particularly concerns a crib convertible to a bed, a kit for forming one of a crib and a bed, and a method for converting a crib to a bed.

BACKGROUND OF THE INVENTION

Known in the art are cribs used as sleeping means for infants, generally from birth until an age of two to three years of age. Conventional cribs typically include a mattress support board adapted to receive and support the crib mattress, as well as a headboard, footboard, and longitudinal side panels forming a boundary enclosing the entire periphery of mattress support board for the purpose of protecting and preventing the infant from rolling off, climbing out or otherwise falling out of the crib into the floor. Moreover, cribs are commonly structured such that the mattress support board may be adjustable in height so as to allow the infant to be placed on the mattress or removed therefrom without undue effort by the parent or the person attending the infant, while ensuring that a sufficiently safe distance is maintained between the mattress and the top portion of the crib.

As an infant grows and matures on through his or her childhood, bedding requirements change, and the appropriate bedding furniture changes from a crib to a different and generally larger bed, such as a youth bed or a twin bed. Twin beds are suitable for persons ranging in size from young children to full-sized adults. In North America, crib mattresses typically are about 27 inches wide and about 52 inches long, while twin bed mattresses typically are about 39 inches wide and about 75 inches long. One drawback associated with the child growing is the cost, time, and effort associated with finding, purchasing, and installing the new bed and to remove, store or discard the crib. One method of addressing these issues consisting in providing and designing convertible bed furniture that may be configured to form either a crib or, as the child grows through childhood, a larger bed.

Numerous attempts have been proposed to provide infant's cribs which are convertible to one or more bed configurations including youth beds, twin beds, and full-sized beds. Examples of such convertible bed systems are disclosed in the following patents and patent applications:

US 2005/002302 A1
U.S. Pat. No. 5,146,631;
GB 2,245,825 A;
U.S. Pat. No. 5,715,551;
U.S. Pat. No. 5,790,994;
WO 2010/026665 A1;
EP 0,356,277 A1;
U.S. Pat. No. 7,712,162 B2.
U.S. Pat. No. 5,754,993;
JP 2102452;
DE 198 48 250 A1;

Although existing convertible cribs may be suitable in some applications, there remain various disadvantages associated therewith. One drawback of many of such designs is that they provide convertible cribs that may convert to full-size or double beds, but not to twin beds. However, twin beds are generally more suitable for young children as they occupy less space in what is often a smaller sized bedroom and are more than sufficiently large for use by a child. For example, known in the art are North American standard cribs having an outside length of about 54 inches and an inside length of about 52 inches, which may be convertible into a double or full-sized bed having an outside width of about 54 inches. For such convertible cribs, the two longitudinal side panels, which extend along the lengthwise direction of the crib for connecting the headboard and footboard thereof, are converted into the headboard and footboard of the bed, respectively, the headboard and footboard of the bed each having a width corresponding to the length of the longitudinal side panel. However, child bedrooms are often too small to accommodate a full-sized bed having a 54-inch outside width.

In view of the above, there exists a need for a crib that can be easily and conveniently converted to a bed having a width that is less than a length of the crib, while also alleviating at least some of the drawbacks of the prior art.

SUMMARY OF THE INVENTION

An object of the present invention is to satisfy at least one of the above-mentioned needs.

In accordance with an aspect of the invention, there is provided a crib convertible to a bed, the crib having a length greater than a width of the bed. The crib includes:

a crib mattress support board, the crib mattress support board including a main support member having a length less than the length of the crib, and at least one extension support member being removably attached to the main support member;

a pair of oppositely-facing longitudinal side panels, each including a main panel member having a length less than the length of the crib, and at least one extension panel member being removably attached to the main panel member;

a pair of oppositely-facing transverse side panels, the crib mattress support board, the pair of longitudinal side panels and the pair of transverse side panels being perpendicularly removably attached one to another so as to define a crib frame of the crib, wherein the main support member of the crib mattress support board is convertible, upon detachment of each extension support member therefrom, to a headboard of the bed, the headboard of the bed having a width substantially equal to the length of the main support member, and wherein the main panel member of each of the pair of longitudinal side panels is convertible, upon detachment of each respective extension panel member therefrom, to a corresponding one of a pair of bed mattress support members disposable along a lengthwise direction of the bed, each bed mattress support member having a width substantially equal to the length of the corresponding main panel member.

Preferably, embodiments of the present invention provide a new and improved crib, which is convertible to a twin bed. Advantageously, embodiments of the present invention provide a crib which is conveniently and easily convertible to a bed. Further advantageously, the crib according to embodiments of the invention may be easily and economically fabricated using standard manufacturing techniques.

In accordance with another aspect of the invention, there is provided a kit for forming one of a crib and a bed, the crib having a length greater than a width of the bed. The kit includes:

common components including:

a main support member;

a pair of main panel members; and a pair of leg members, the main support member, the pair of main panel members and the pair of leg members each having a length which is less than the length of the crib and substantially equal to the width of the bed;

crib components including:

at least one extension support member removably attachable to the main support member for forming, upon attachment therewith, a crib mattress support board;

a pair of at least one extension panel member, each at least one extension panel member being removably attachable to a corresponding one of the pair of main panel members for forming, upon attachment therewith, a corresponding pair of longitudinal side panels; and a pair of transverse side panels, and bed components including a pair of elongated members removably attachable to the pair of leg members for forming four sides of a bed frame of the bed.

In a crib configuration, the crib mattress support board, the pair of longitudinal side panels and the pair of transverse side panels are perpendicularly removably attachable one to another so as to define a crib frame of the crib.

In a bed configuration:

the pair of elongated members are adapted for serving as a pair of lengthwise sides of the bed frame and the pair of leg members are adapted for serving as headboard and footboard sides of the bed frame, each of the headboard and footboard sides having a width substantially equal to the length of each leg member;

the main support member is attachable to the headboard side of the bed frame for forming a headboard of the bed having a width substantially equal to the length of the main support member, and each of the main panel members is attachable at opposite sides thereof to the pair of elongated members for forming a corresponding one of a pair of bed mattress support members, each bed mattress support member having a width substantially equal to the length of the corresponding main panel member.

Advantageously, embodiments of the present invention provide a kit of components which, when assembled in the crib and bed configuration, yield a crib and a bed, respectively, which are sufficiently rigid, sturdy, and secure.

In accordance with another aspect of the invention, there is provided a kit for forming a crib convertible into a bed, the crib having a length greater than a width of the bed. The kit includes:

a main support member;

a pair of main panel members;

a pair of leg members, the main support member, the pair of main panel members and the pair of leg members each having a length which is less than the length of the crib and substantially equal to the width of the bed;

at least one extension support member removably attachable to the main support member for forming, upon attachment therewith, a crib mattress support board; and a pair of at least one extension panel member, each at least one extension panel member being removably attachable to a corresponding one of the pair of main panel members for forming, upon attachment therewith, a corresponding pair of longitudinal side panels; and a pair of transverse side panels.

In a crib configuration, the crib mattress support board, the pair of longitudinal side panels and the pair of transverse side panels are perpendicularly removably attachable one to another so as to define a crib frame of the crib.

In a bed configuration, and with an addition of bed components including a pair of elongated members removably attachable to the pair of leg members for forming four sides of a bed frame of the bed:

the pair of elongated members are adapted for serving as a pair of lengthwise sides of the bed frame and the pair of leg members are adapted for serving as headboard and footboard sides of the bed frame, each of the headboard and footboard sides having a width substantially equal to the length of each leg member;

the main support member is attachable to the headboard side of the bed frame for forming a headboard of the bed having a width substantially equal to the length of the main support member, and each of the main panel members is attachable at opposite sides thereof to the pair of elongated members for forming a corresponding one of a pair of bed mattress support members, each bed mattress support member having a width substantially equal to the length of the corresponding main panel member.

In accordance with another aspect of the invention, there is provided a kit for forming a bed from a crib, the crib having a length greater the crib having a length greater than a width of the bed. The crib includes:

a main support member;

a pair of main panel members; and a pair of leg members, the main support member, the pair of main panel members and the pair of leg members each having a length which is less than the length of the crib and substantially equal to the width of the bed.

The kit includes a pair of elongated members removably attachable to the pair of leg members for forming four sides of a bed frame of the bed.

In a bed configuration:

the pair of elongated members are adapted for serving as a pair of lengthwise sides of the bed frame and the pair of leg members are adapted for serving as headboard and footboard sides of the bed frame, each of the headboard and footboard sides having a width substantially equal to the length of each leg member;

the main support member is attachable to the headboard side of the bed frame for forming a headboard of the bed having a width substantially equal to the length of the main support member, and each of the main panel members is attachable at opposite sides thereof to the pair of elongated members for forming a corresponding one of a pair of bed mattress support members, each bed mattress support member having a width substantially equal to the length of the corresponding main panel member.

In accordance with another aspect of the invention, there is provided a method of converting a crib as described above to a bed. The method includes the steps of:

separating from the crib the main support member of the crib mattress support board and the main panel member of each of the pair of longitudinal side panels;

providing a bed frame of the bed;

mounting the main support member on the bed frame as a headboard of the bed; and connecting each main panel member to the bed frame as a bed mattress support member of a bed mattress support board of the bed.

Other features and advantages of the present invention will be better understood upon reading of preferred embodiments thereof, provided merely by way of non-limitative examples, and upon referring to the appended drawings.

BRIEF DESCRIPTION OF THE DRAWINGS

In FIG. 7B, the crib mattress support board has been removed for illustrating the four corner support elements.

Figure 1:
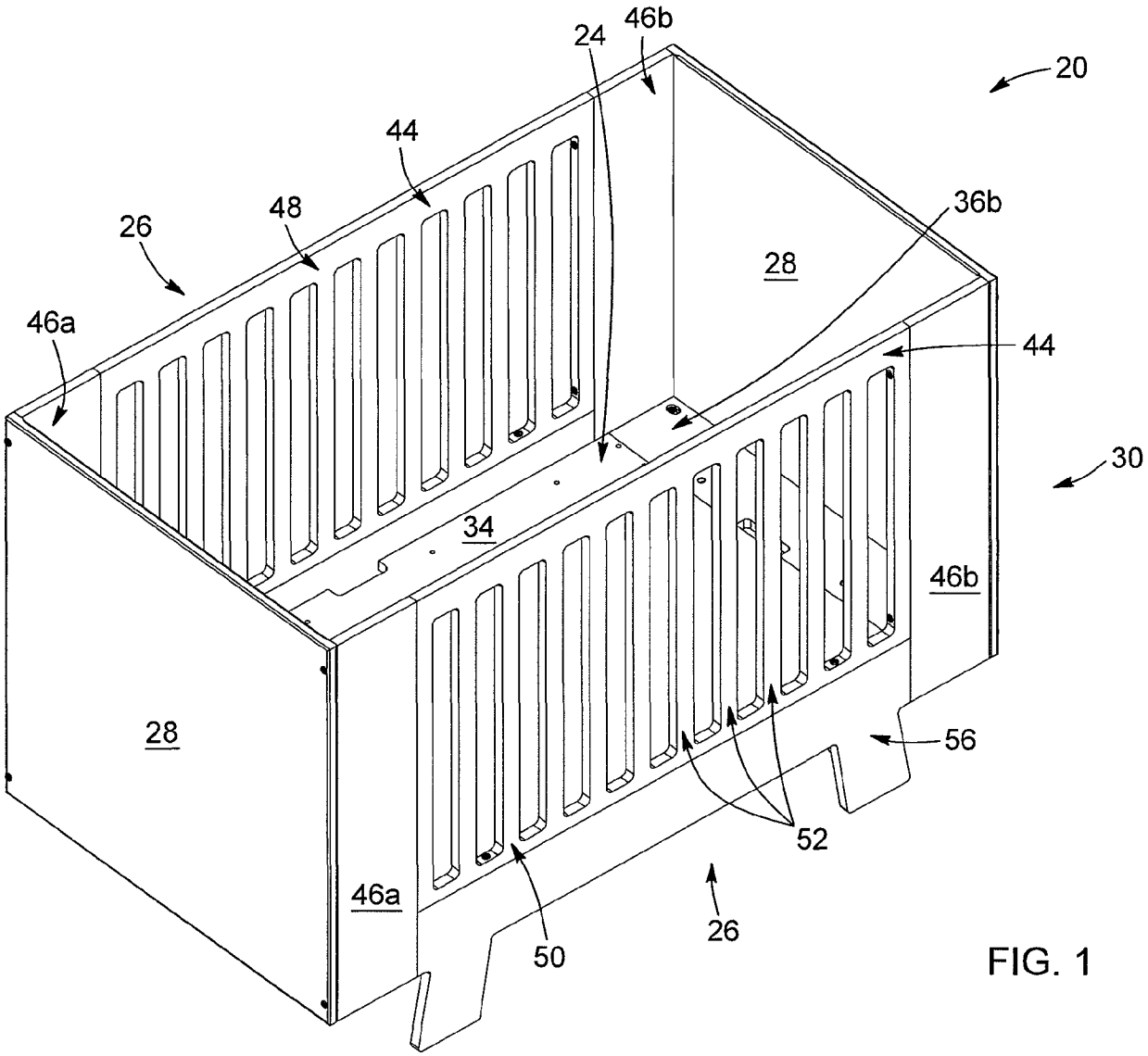
FIG. 1 is an assembled perspective view of a crib according to an embodiment of the invention.

While the invention will be described in conjunction with example embodiments, it will be understood that it is not intended to limit the scope of the invention to such embodiments. On the contrary, it is intended to cover all alternatives, modifications and equivalents, as may be included in the present description.

DESCRIPTION OF PREFERRED EMBODIMENTS OF THE INVENTION

In the following description, similar features in the drawings have been given similar reference numerals and, in order to weigh down the figures, some elements are not referred to on some figures if they were already identified in preceding figures.

According to an aspect of the invention, there is provided a crib convertible to a bed, the crib having a length greater than a width of the bed.

As used herein, the term "crib" is meant to refer to a sleeping apparatus primarily intended for used by infants and very young children. Cribs are generally provided with walls, bars or other protecting and restrictive means to prevent an infant from falling out of the crib. The term "bed" is meant to refer herein to any article of furniture for sleeping or resting purposes which includes at least one open edge via which a person can enter and exit.

As used herein, the term "convertible" is intended to mean that the crib is configured to be readily changed to a bed by rearranging and/or eliminating components making up the crib so as to form the bed. In some embodiments, extra parts or elements may have to be used, in addition to the crib components, in order to form the bed.

The terms "length" and "width" as used throughout the present description with reference the crib, the bed or components thereof, refer to dimensions which are measured along a plane of the sleeping surface of the crib or bed. More specifically, the term "length" is intended to designate a dimension measured along a direction extending between the headboard and footboard of a crib or bed, while the term "width" is intended to designate a dimension taken at right angle to the length.

Figure 2:
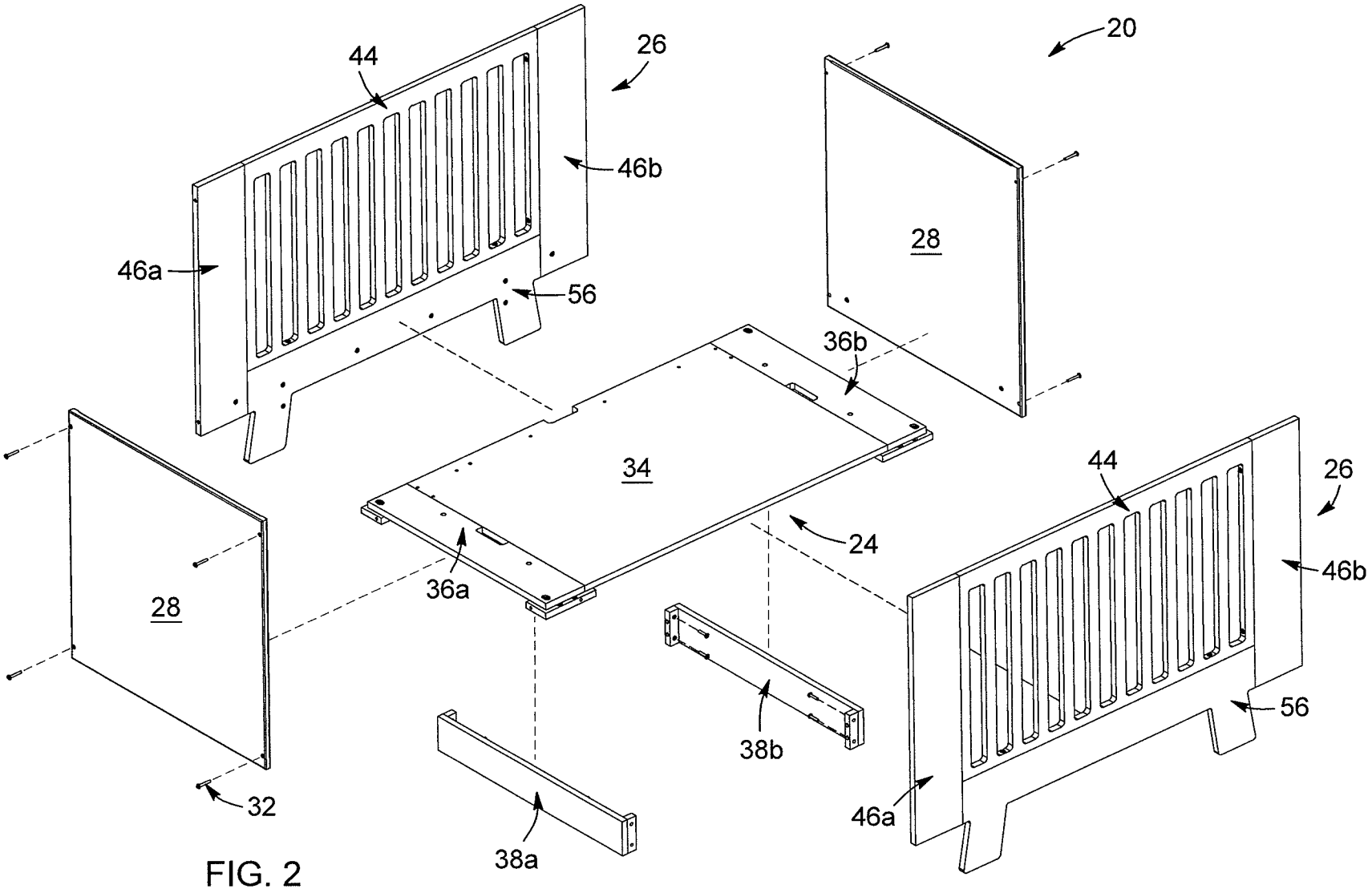
FIG. 2 is an exploded perspective view of the crib shown in FIG. 1.

Referring to FIGS. 1 and 2, there are shown assembled and exploded perspective views, respectively, of a crib 20, in accordance to an embodiment of the invention. As described in further detail below, the crib 20 is convertible into a bed 22, such as that shown in FIGS. 5 and 6, wherein the crib 20 having a length greater than a width of the bed 22. For example, in a preferred embodiment, the crib may have a length of about 53½ inches and a width of about 29½ inches and may be convertible into a bed having a length of about 76½ inches and a width of about 40½ inches, suitable for accommodating a twin bed mattress. However, it will be readily understood by one of ordinary skill in the art that numerous combinations of crib and bed dimensions, which may but need not be standard, are encompassed within the scope of the invention, as long as the length of the crib remains greater than the width of the bed.

Still referring to FIGS. 1 and 2, the crib 20 generally includes a crib mattress support board 24, which defines a sleeping area of the crib 20, as well as a pair of oppositely-facing longitudinal side panels 26, and a pair of oppositely-facing transversely side panels 28, which surround the sleeping area of the crib 20 for safety purposes. The crib mattress support board 24, the pair of longitudinal side panels 26 and the pair of transverse side panels are perpendicularly removably attached one to another so as to define a crib frame 30 of the crib 20. In the illustrated embodiment, the crib frame 30 is substantially shaped as a rectangular prism having a bottom horizontal face defined by the crib mattress support board 24, four vertical side faces defined by the pairs of longitudinal and transverse side panels 26 and 28, and a top horizontal face having an open end. However, in other embodiments, the crib frame 30 may assumed other shapes without departing from the scope of the present invention. For example, in an alternate embodiment, the longitudinal and transverse side panels 26 and 28 may have different heights.

As one of ordinary skill in the art will readily understand, the crib mattress support board 24, the pair of longitudinal side panels 26 and the pair of transverse side panels illustrated in FIGS. 1 and 2 may be made of numerous materials, or combinations of materials, including, but not limited to, wood, composite fiberboard, metal, plastic and a combination thereof. It will also be apparent to one of ordinary skill in the art that the terms "board" and "panels" should not be construed as limiting and numerous structures or combinations of structures may be appropriate to form the crib frame 30, including, without being limited to solid pieces, spindles, slats, screens, meshes or panels.

The terms "removably attached" and "removably connected", and variants thereof, as used throughout the present description with reference to two or more elements, is intended to mean that the elements are secured, joined or otherwise connected to one another in a manner that permits the elements to be separated without damaging or permanently deforming the elements or any fasteners or attachments devices used to secure, join or connect the elements to one another.

It will also be readily apparent to one of ordinary skill in the art that, regardless of the removable character of the connections established when the crib mattress support board, the longitudinal side panels and the transversely side panels are attached one to another, the connections are preferably sufficiently strong and reliable for providing an adequate mechanical stability to the crib. The term "removably attached" is further intended to mean that attachment and detachment of the crib mattress support board, the longitudinal side panels and the transversely side panels is preferably achieved relatively easily and quickly by hand or by using common hand tools such as a screwdriver, a wrench or another driving tool.

One of ordinary skill in the art will also understand that the exact nature of the fasteners, attachment devices or connecting hardware used to connect the various panels, boards, elements, components and members found in the embodiments of present invention is not absolutely vital. The same may likewise be said regarding the attachment locations, that is, the locations where the various panels, boards, elements, components and members may connect. Hence, the particular type of fastener used for joining two or more elements at a given attachment location may vary, although the fastener should preferably provide secure attachment, while providing a convenient way to detach the elements from each other. For example, in the embodiment illustrated in FIGS. 2, 3, 4 and 6, attachment between the various components of the cribs are primarily provided by screws 32. However, numerous other types of fasteners that are commonly used in the art may be utilized including, bolts, rivets, hooks, nails, dowels, glue, hook and loop fasteners, latches, lock washers, as well as tab and slot, post and keyhole, and mortise and tenon arrangements.

Figure 5:
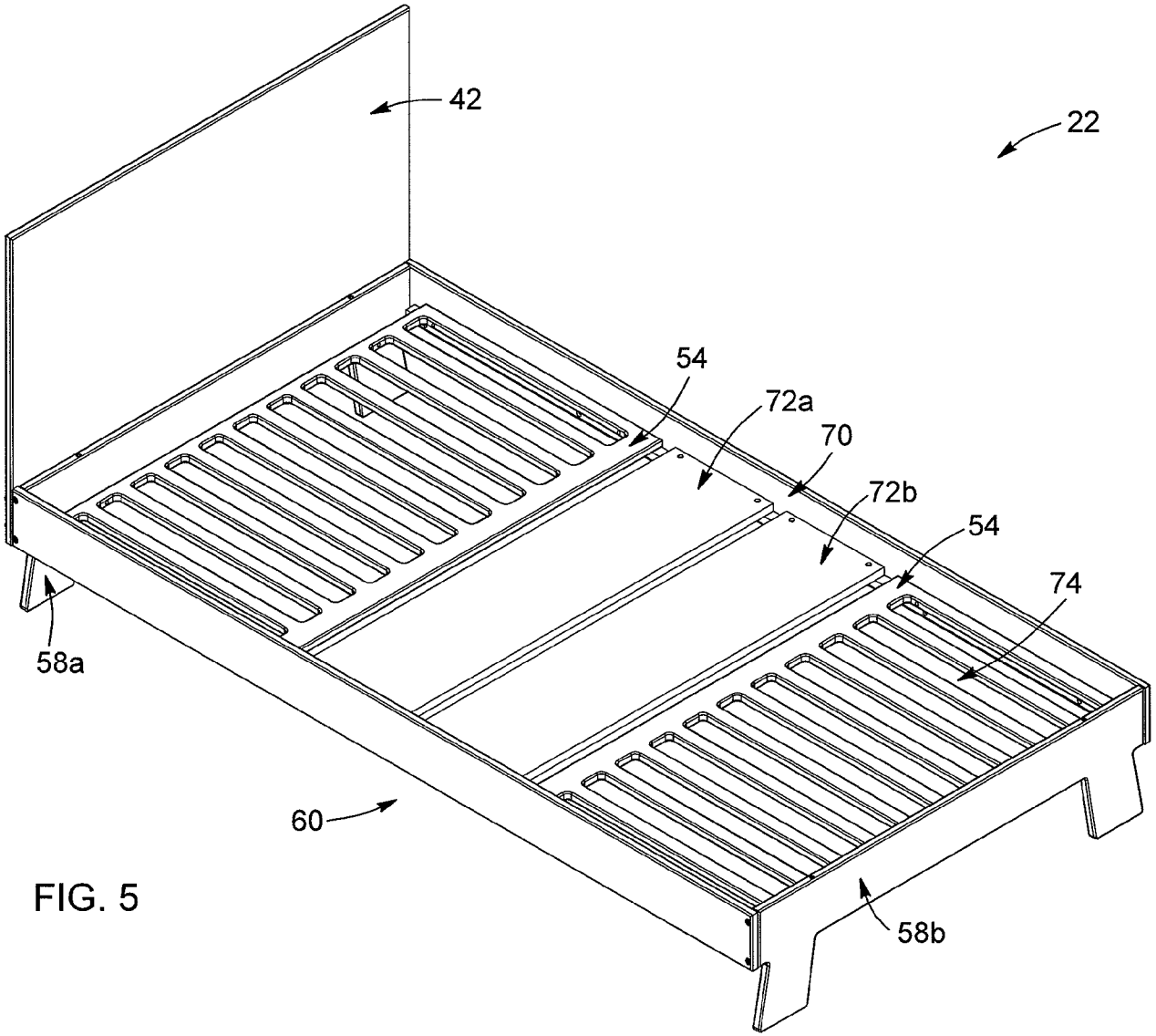
FIG. 5 is an assembled perspective view of an exemplary bed to which the crib shown in FIG. 1 may be converted.

Moreover, for aesthetic purposes, the crib according to embodiments of the invention may preferably use internal attachment locations that may not be readily noticeable, either when the crib components are assembled in a crib configuration (see, e.g., FIG. 1) or dissembled, rearranged and reassembled in a bed configuration (see, e.g., in FIG. 5).

Figure 3:
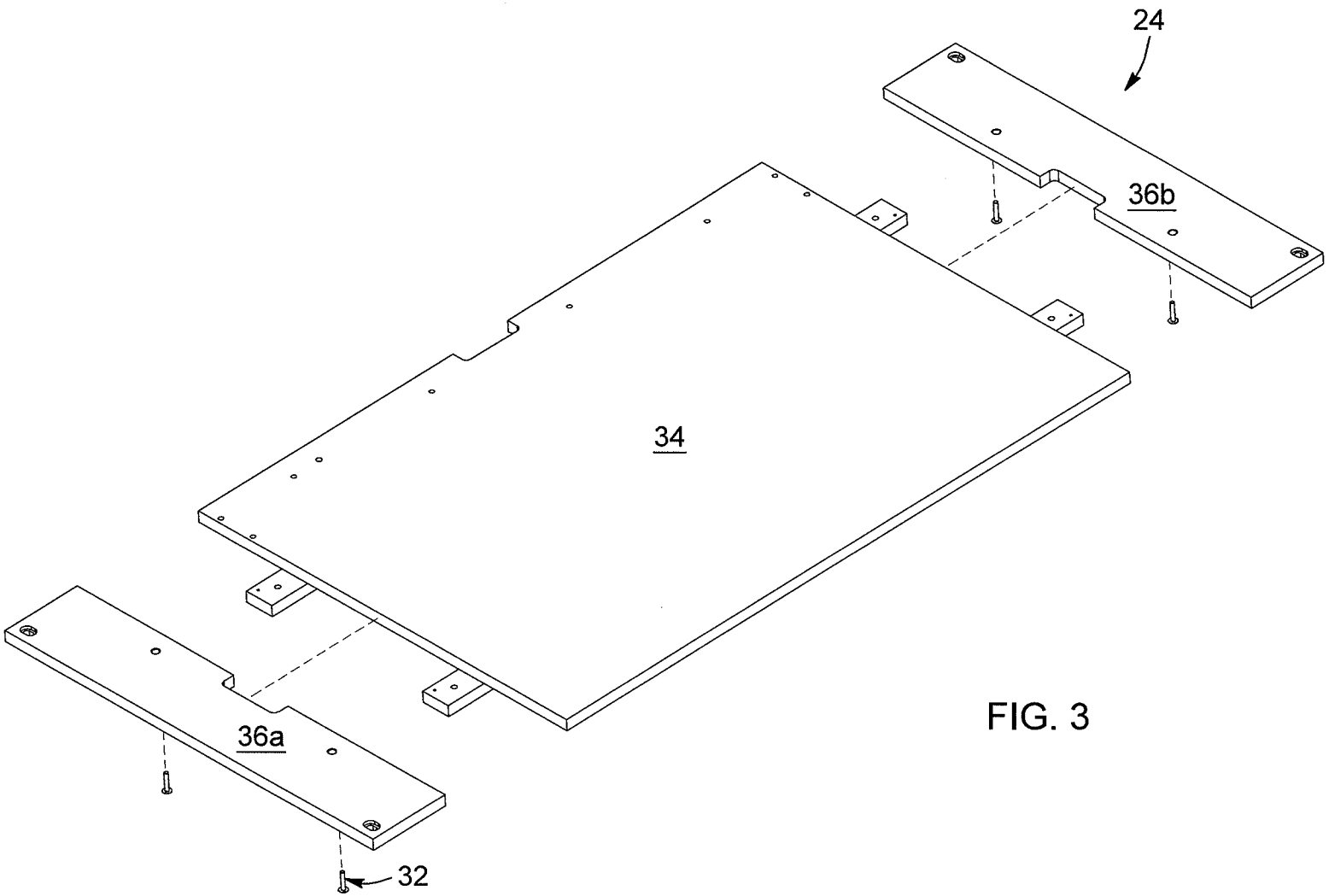
FIG. 3 is an exploded perspective view of the crib mattress support board of the crib shown in FIG. 1.

As better shown in FIGS. 1 to 3, the crib mattress support board 24 includes a main support member 34 having a length less than the length of the crib 20, and at least one extension support member 36*a*, 36*b* being removably attached to the main support member 34. For example, in one embodiment, the crib mattress support board 24 may have a length of about 53½ inches, which may correspond substantially to the length of the crib 20, while the main support member 34 may have a length of about 40½ inches.

The crib mattress support board 24 is preferably embodied by a flat, generally rectangular solid panel. As mentioned above, the crib support mattress board may be removably attached to the crib frame 30 according to various configurations and fasteners. For example, the crib 20 may preferably include at least one connecting member extending widthwise between the two longitudinal side panels 26 or lengthwise between the two transverse side panels 28, each connecting member being adapted for receiving and supporting the crib mattress support board 24. More specifically, the embodiment illustrated in FIGS. 2, 7A and 7B includes two spaced-apart connecting members 38*a*, 38*b* extending along the widthwise direction of the crib 20 and removably connecting the pair of longitudinal side panels 26.

Figure 7A:
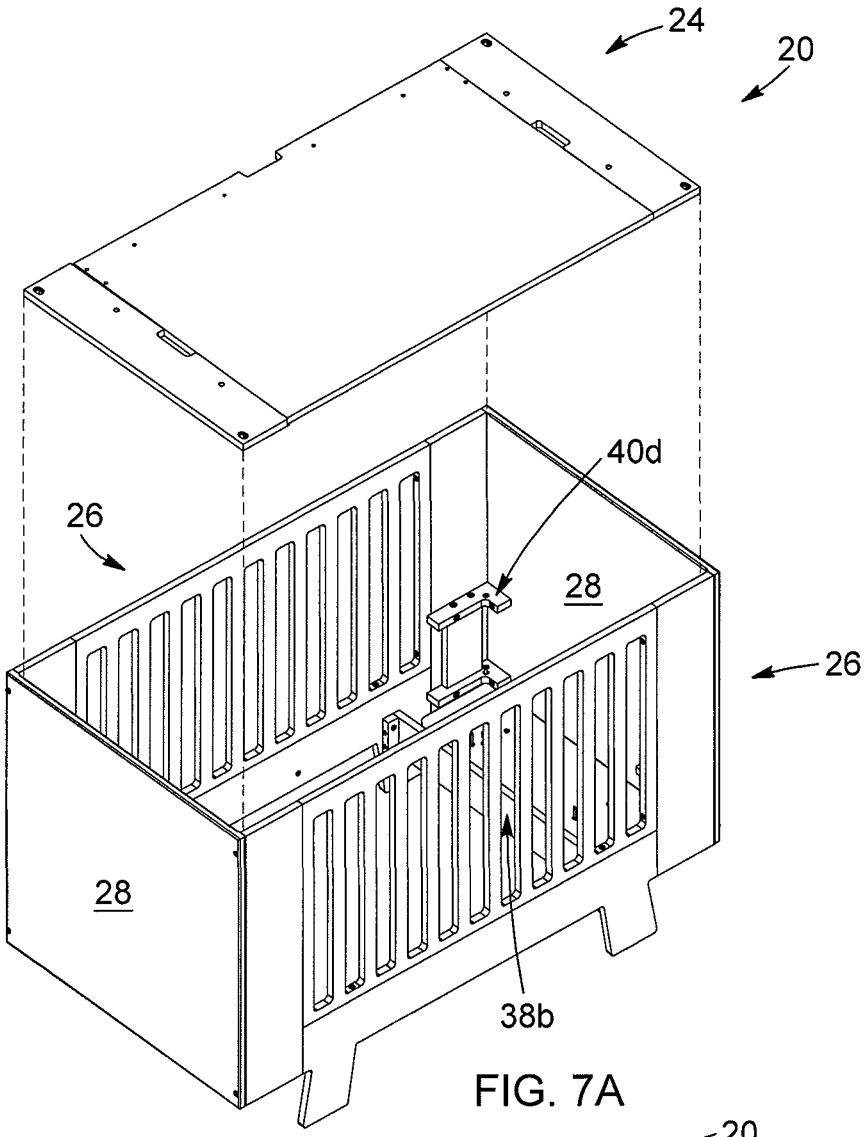
FIGS. 7A and 7B are a partially exploded view and a top plan view, respectively, of a crib according to another embodiment of the invention, exposing four corner support elements removably attached to the crib frame at four corresponding corners thereof, the four corner support elements being adapted to receive the crib mattress support board at an elevated position relative to a bottom surface of the crib frame.
Figure 7B:
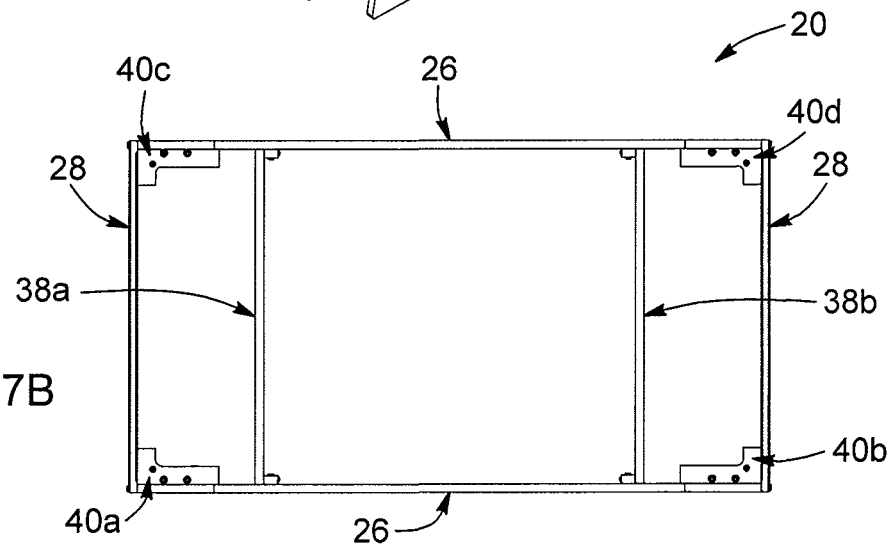

Preferably also, the crib mattress support board 24 is adapted to receive and support a crib mattress (not shown) upon which an infant may be placed and sleep. For example, in one embodiment, the crib mattress support board 24 may have a length of about 53½ inches and a width of about 29½ inches, which is sized and shaped so as to snugly receive and support a conventional crib mattress of about 52 inches in length and 27 inches in width. In the embodiment illustrated in FIG. 1, the crib mattress support board 24 is located near a bottom surface of the crib frame 30. However, depending on various factors including the age, size and level of development of the infant, it may be desirable to have the possibility of placing the crib mattress support board 24 in an elevated position. In this regard, FIGS. 7A and 7B show a partially exploded perspective view and a top plan view of a crib 20 according to another embodiment of the invention, wherein the crib 20 further includes four corner support elements 40*a* to 40*d* removably attached to the crib frame 30 at four corresponding corners thereof, the four corner support elements 40*a* to 40*d* being adapted to receive the crib mattress support board 24 and to maintain the same at an elevated position relative to a bottom surface of the crib frame 30.

Referring back to the embodiment illustrated in FIGS. 1 to 3, the at least one extension support member 36*a*, 36*b* of the crib mattress support board 24 preferably includes a first and a second extension support member 36*a*, 36*b* removably attached to opposite sides of the main support member 34 such that the crib mattress support board 24 extends along a lengthwise direction of the crib 20 in the order of the first extension support member 36*a*, the main support member 34, and the second extension support member 36*b*. It will be understood that, in other embodiments, the first and second extension support members 36*a*, 36*b* may have different size or shape without departing from the scope of the invention. It will also be readily understood that, in other embodiments, one or more than two extension support members may be provided without departing from the scope of the invention, as long as the length of the main support member remains less than the length of the crib.

As discussed above, as an infant grows and matures on through his or her child, bedding requirements change and the appropriate bedding furniture changes from a crib to a different and generally larger bed. In this regard, the crib according to embodiments of the present invention is convertible to a bed by disassembling, removing, rearranging and reassembling at least some of the crib components to provide a bed, wherein the bed has a width which is less than the length of the crib.

Figure 6:
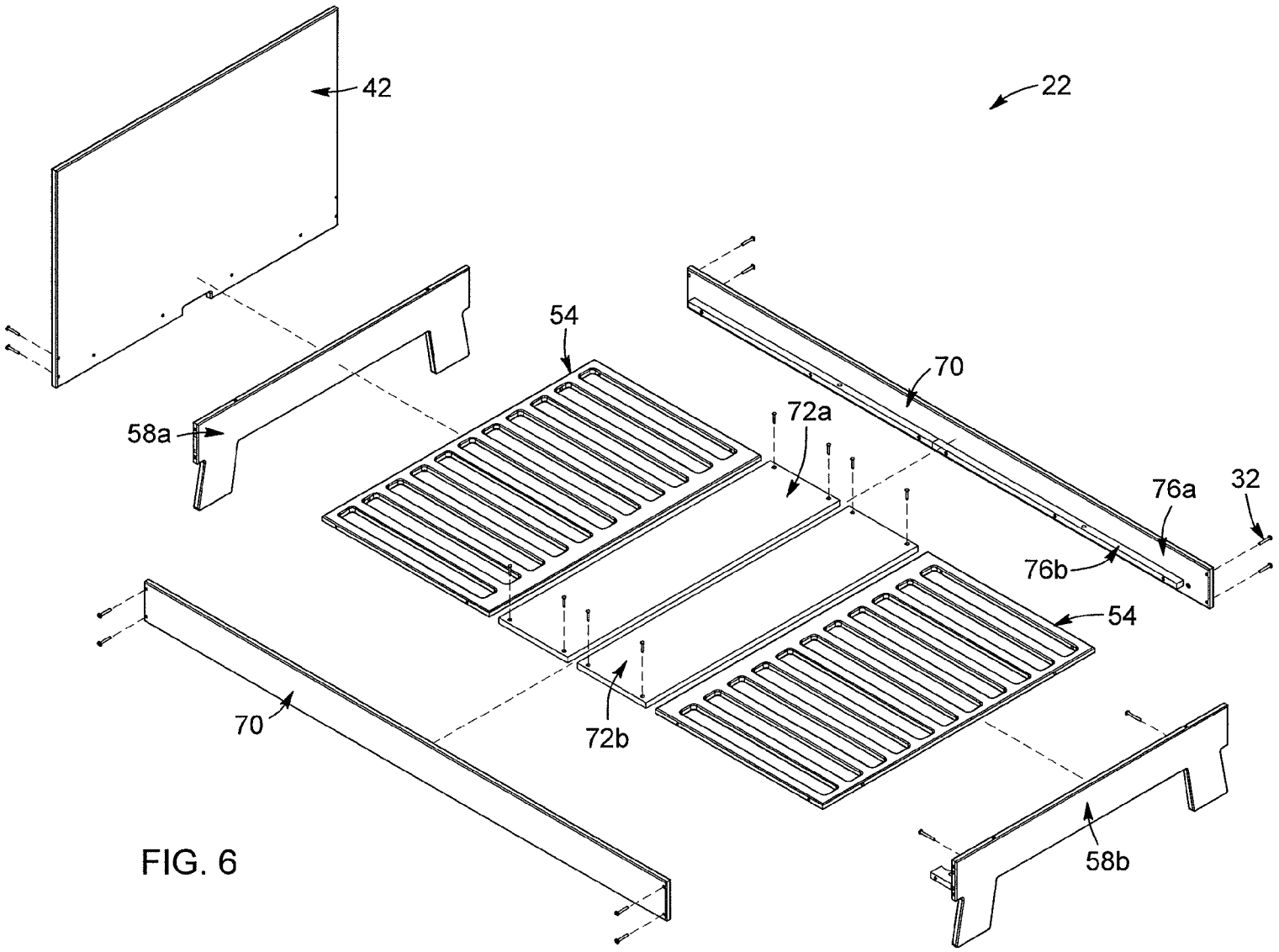
FIG. 6 is an exploded perspective view of the bed shown in FIG. 5.

For the purposes of converting the crib 20 to a bed 22, the main support member 34 of the crib mattress support board 24 is convertible, upon detachment of each extension support member 36*a*, 36*b* therefrom and as illustrated in FIGS. 5 and 6, to a headboard 42 of the bed 22, the headboard 42 of the bed 22 having a width substantially equal to the length of the main support member 34. Moreover, it will be understood that the width of the headboard 42 of the bed 22 substantially corresponds to the width of the bed 22. Therefore, in a preferred embodiment, a crib 20 having a length of about 53½ inches may include a crib mattress support board 24 provided with a main support member 34 having a length of about 40½ inches, which may be converted to the headboard 42 of a bed 22 having width of about 40½ inches.

Figure 4:
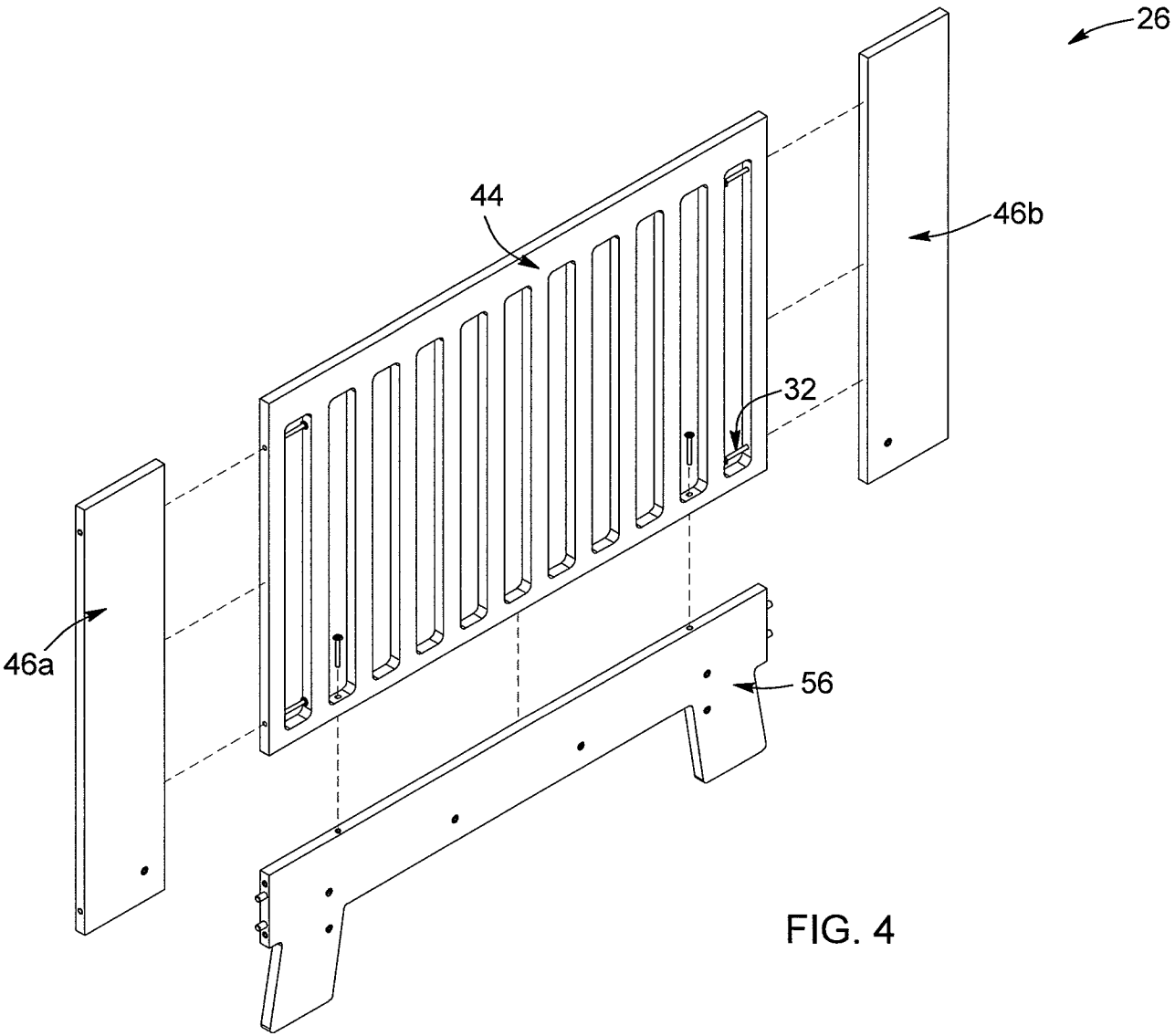
FIG. 4 is an exploded perspective view of one of the pair of longitudinal side panels of the crib shown in FIG. 1.

Referring now to FIGS. 1, 2 and 4, each of the pair of oppositely-facing longitudinal side panels 26 include a main panel member 44 having a length less than the length of the crib 20, and at least one extension panel member 46*a*, 46*b* being removably attached to the main panel member 44. Each longitudinal side panel 26 is preferably embodied by a flat, generally rectangular panel. In the illustrated embodiment, the two longitudinal side panels 26 are removably attached together via the two spaced-apart connecting members 38*a*, 38*b* extending along the widthwise direction of the crib 20. Each longitudinal side panels 26 is also preferably perpendicularly removably attached by screws or other appropriate fasteners to the two transverse side panels 28 at opposite sides thereof. However, other attachment locations and configuration are possible without departing from the scope of the invention.

As described above with reference to the crib mattress support board 24, in one exemplary embodiment, each longitudinal side panel 26 may have a length of 53½ inches, which may correspond substantially to the length of the crib 20, while the main panel member 44 may have a length of about 40½ inches. Alternatively, other dimensions may be considered without departing from the scope of the invention. Preferably also, but not necessarily, the length of the main panel member 44 of each longitudinal side panels 26 is substantially equal to the length of the main support member 34 of the crib mattress support board 24.

In the illustrated embodiment, the main panel member 44 of each of the pair of longitudinal side panels 26 includes a horizontal top portion 48, an opposite horizontal bottom portion 50, and a plurality of vertical rungs 52 extending vertically between the top and bottom portions 48 and 50. Moreover, in the illustrated embodiments, each of the pair of transverse side panels 28 is embodied by a solid panel that does not feature rungs or spindles. However, other embodiments may include longitudinal and transverse side panels 26 and 28 provided with rungs of various shapes, sizes, orientation and spacing without departing from the scope of the invention. It will be understood that the shape, size, orientation and spacing of the rungs preferably comply with appropriate safety regulations.

The at least one extension panel member 46*a*, 46*b* of each longitudinal side panel 26 preferably includes a first and a second extension panel member 46*a*, 46*b* removably attached to opposite sides of the main panel member 44 such that each longitudinal side panel 26 extends along a lengthwise direction of the crib 20 in the order of the first extension panel member 46*a*, the main panel member 44, and the second extension panel member 46*b*. It will be understood that, in other embodiments, the first and second extension panel members 46*a*, 46*b* may have different size or shape without departing from the scope of the invention. Likewise, they may, but need not, have the same length as the extension support members 36*a*, 36*b* of the crib mattress support board 24. It will also be readily understood that, in other embodiments, one or more than two extension panel members may be provided without departing from the scope of the invention, as long as the length of the main panel member remains less than the length of the crib.

As described above with reference to the main support member 34 of the crib mattress support board 24, for the purposes of converting the crib 20 to a bed 22, the main panel member 44 of each of the pair of longitudinal side panels 26 is convertible, upon detachment of each respective extension panel member 46*a*, 46*b* therefrom, to a corresponding one of a pair of bed mattress support members 54 disposable along a lengthwise direction of the bed 22, as illustrated in FIGS. 5 and 6. In particular, each bed mattress support member 54 has a width substantially equal to the length of the corresponding main panel member 44. It will be understood that the width of each bed mattress support member 54 of the bed 22 substantially corresponds to the width of the bed 22. Therefore, in a preferred embodiment, a crib 20 having a length of about 53½ inches may include a pair of longitudinal side panels 26, each provided with a main panel member 44 having a length of about 40½ inches and convertible into one of a pair of bed mattress support member 54 of a bed 22.

Figure 8A:
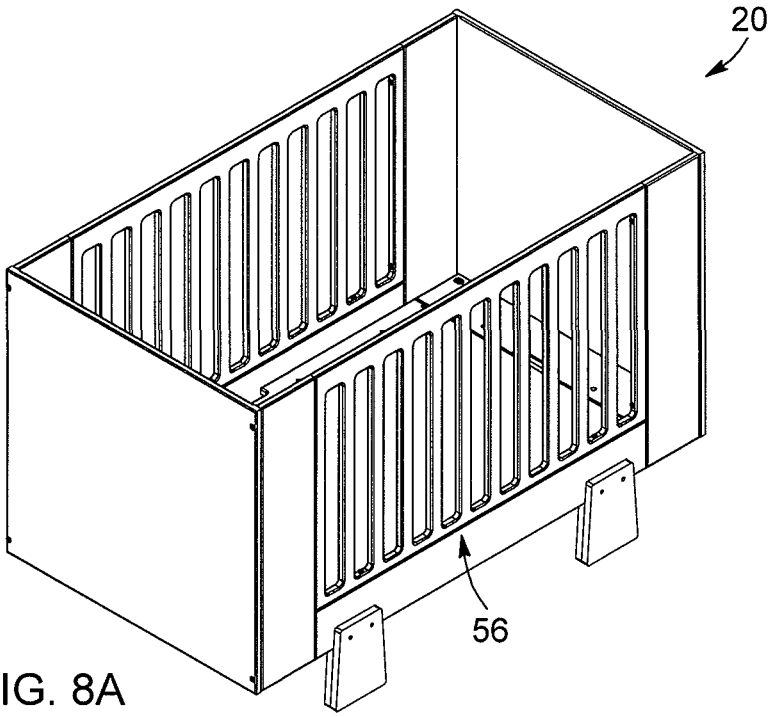
FIG. 8A is an assembled perspective view of a crib according to an embodiment of the invention, wherein the crib leg support members are different than those in the embodiment of FIG. 1.
Figure 8B:
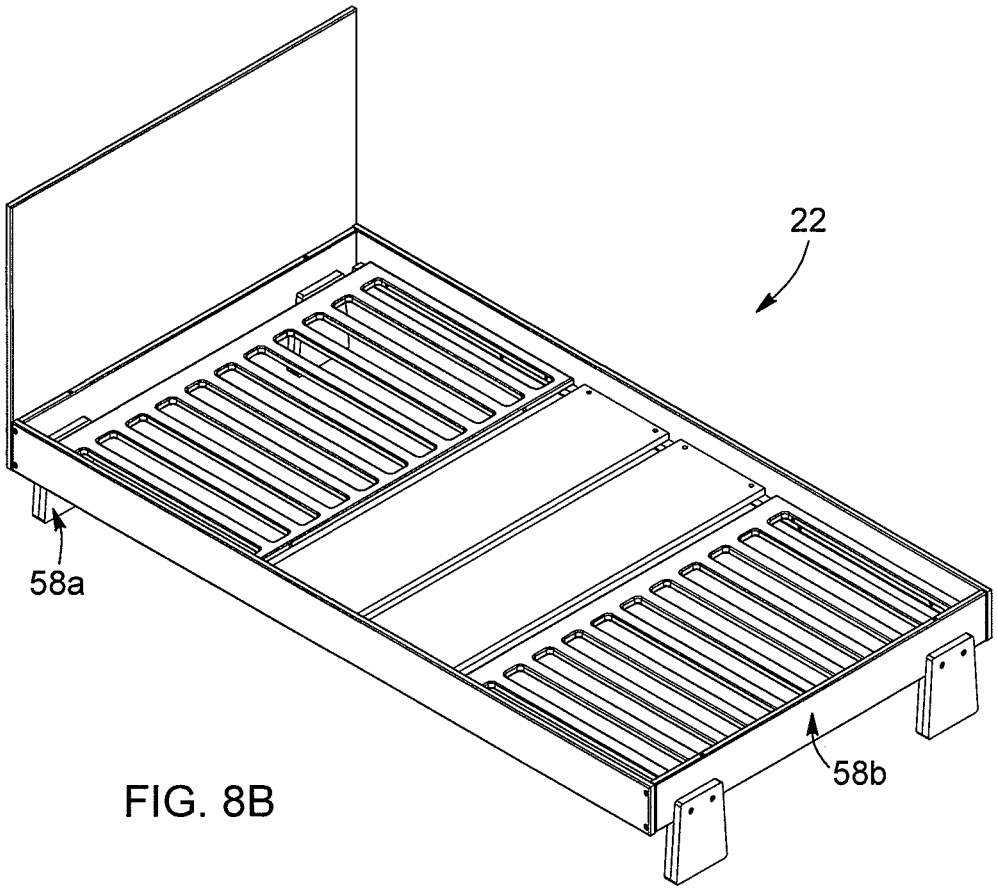
FIG. 8B is an assembled perspective view of an exemplary bed to which the crib shown in FIG. 8A may be converted.
Figure 9A:
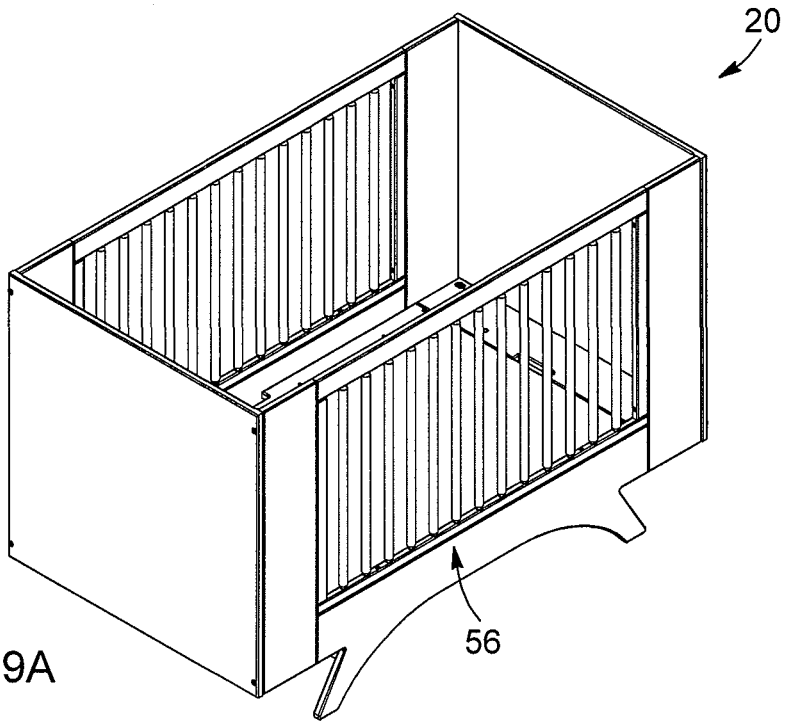
FIG. 9A is an assembled perspective view of a crib according to an embodiment of the invention, wherein the crib leg support members are different than those in the embodiments of FIGS. 1 and 8A.
Figure 9B:
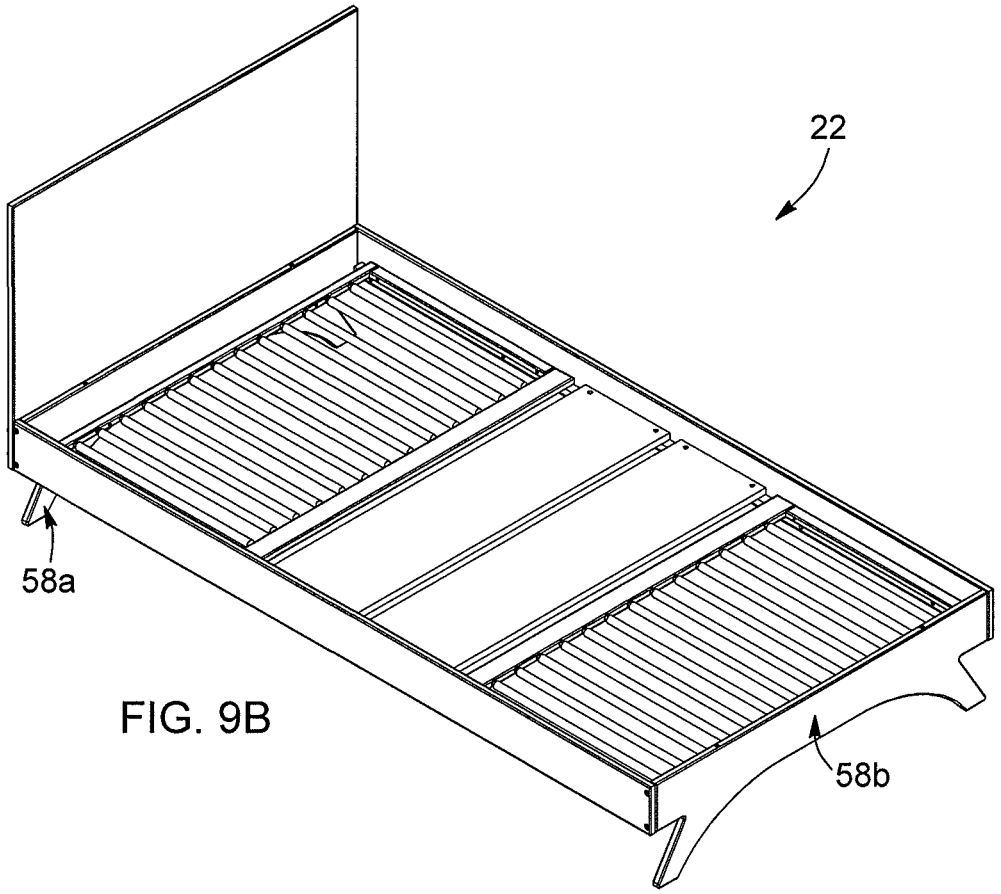
FIG. 9B is an assembled perspective view of an exemplary bed to which the crib shown in FIG. 9B may be converted.
Figure 10A:
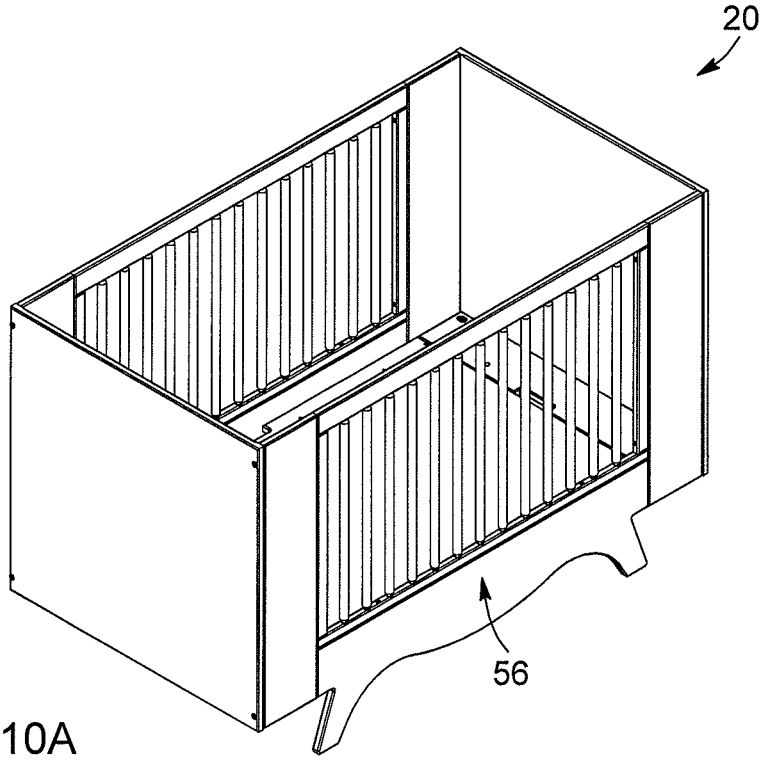
FIG. 10A is an assembled perspective view of a crib according to an embodiment of the invention, wherein the crib leg support members are different than those in the embodiments of FIGS. 1, 8A and 9A.
Figure 10B:
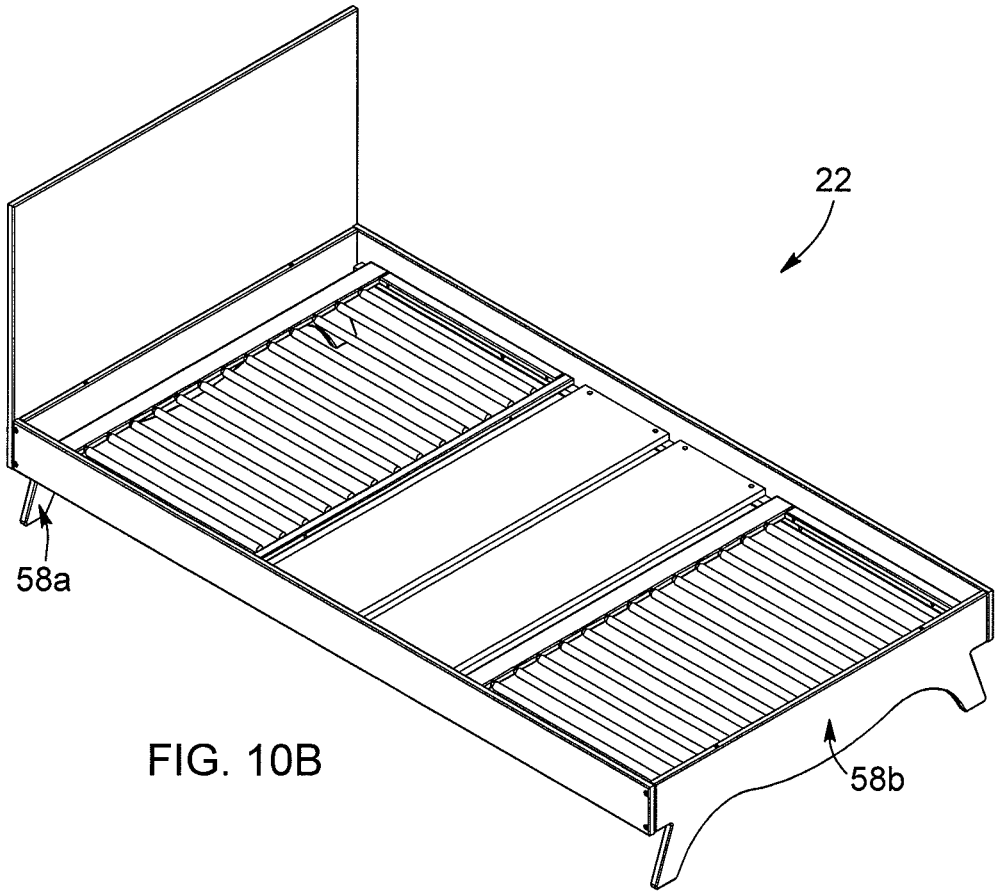
FIG. 10B is an assembled perspective view of an exemplary bed to which the crib shown in FIG. 10B may be converted.

Still referring to FIGS. 1, 2 and 4, the crib 20 may further preferably include a pair of spaced-apart crib leg members 56 removably attached to and downwardly extending from a bottom portion of the crib frame 30 for providing support on a floor surface (not shown). In the illustrated embodiment, each crib leg member 56 preferably has a length less than the length of the crib 20. Further preferably, each one of the pair of crib leg members 56 extends along a lengthwise direction of the crib 20 and is removably attached to a bottom portion of the main panel member 44 of a corresponding one of the pair of longitudinal side panels 26. It will be understood that for structural or aesthetic purposes, the crib leg members may assume of variety of shapes and size, and may include various ornamental or non-ornamental features. For example, FIGS. 8A, 9A and 10A show assembled perspective views of alternate embodiments for the crib 20 provided with crib leg members 56 having different shapes. As in FIG. 1, the crib 20 in each of FIGS. 8A, 9A and 10A is a convertible crib 20 which may be converted to the bed 22 shown in FIGS. 8B, 9B and 10B.

Preferably also, each crib leg members 56 is convertible, upon detachment from the crib frame 30, to a corresponding pair of bed leg members 58*a*, 58*b* adapted for serving as headboard and footboard sides of a bed frame 60 of the bed 22, as illustrated in FIGS. 5 and 6. In this regard, it will be understood that each crib leg member 56 preferably, but not necessarily, has a length substantially equal to both the length of the main panel member 44 of each longitudinal side panels 26 and the length of the main support member 34 of the crib mattress support board 24. Indeed, this particular case, the crib 20 is convertible to a bed whose headboard 42, bed mattress support members 54, and bed frame 60 all have the same width.

One of ordinary skill in the art will readily understand that the convertible crib described above with reference preferred embodiments thereof may be sold and packaged as a kit that includes all components necessary to construct the crib. For such embodiments, other items that may be required to construct the bed may be packaged or sold separately. Alternatively, in other embodiments, a kit may be packaged and sold so as to include all components necessary to construct both the crib and the bed to which the crib may be converted.

Figure 11:
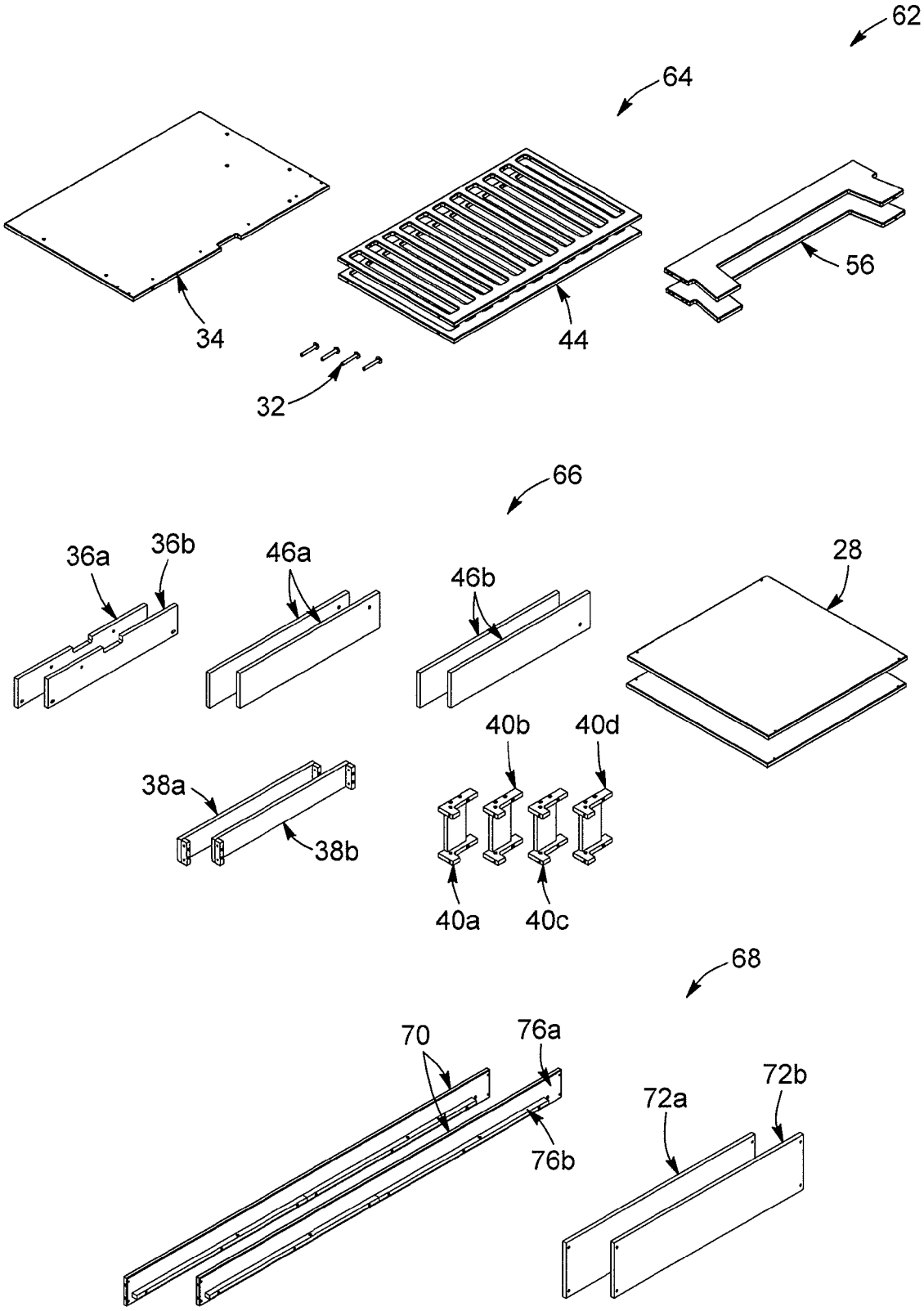
FIG. 11 is a perspective view of a kit for forming one of a crib and a bed, in accordance with an embodiment of the invention.

Hence, according to another aspect of the invention, there is also provided a kit for forming one of a crib and a bed, the crib having a length greater than a width of the bed. Referring now to FIG. 11, there are shown components of a kit 62, in accordance with an embodiment of the invention.

As will be understood from the following description, several components of the kit 62 of FIG. 11 correspond to components of the crib 20 described above and illustrated in FIGS. 1 and 2. Therefore, as will also be understood, the components and any features or variants thereof that were detailed above in relation to embodiments of the crib will not be described in further detail hereinbelow.

Referring back to FIG. 11, the kit 62 first includes common components 64, that is, components which are used to construct both a crib 20 when assembled as part of a crib configuration (see, e.g., FIGS. 1 and 2) and a bed 22 when assembled as part of a bed configuration (see, e.g., FIGS. 5 and 6). These common components 64 may include, without being limited to:

a main support member 34 (42 in the bed configuration);

a pair of main panel members 44 (54 in the bed configuration); and a pair of leg members 56 (58*a*, 58*b* in the bed configuration), wherein the main support member 34, the pair of main panel members 44 and the pair of leg members 56 each having a length which is less than the length of the crib 20 and substantially equal to the width of the bed 22.

One of ordinary skill in the art will readily understand that, in other embodiments, the common components 64 may include various other structural, ornamental or connecting components without departing from the present invention. In particular, it will be understood that the kit 62 according to embodiments of the invention aims at maximizing the number of commonly used components 64, in particular fastening devices such as screws 32, and at minimizing the number of components used for only one of the crib and bed.

Still referring to FIG. 11, the kit 62 also includes crib components 66, that is, components which are used only when the kit 62 is used in the crib configuration. In the illustrated embodiment, the crib components 66 include:

at least one extension support member 36*a*, 36*b* removably attachable to the main support member 34 for forming, upon attachment therewith, a crib mattress support board 24, such as that shown in FIG. 1. As in FIGS. 1 to 3, the embodiment of FIG. 11 includes a first and a second extension support member 36*a*, 36*b*, which are removably attachable to opposite sides of the main support member 34;

a pair of at least one extension panel member 46*a*, 46*b*, each at least one extension panel member 46*a*, 46*b* being removably attachable to a corresponding one of the pair of main panel members 44 for forming, upon attachment therewith, a corresponding pair of longitudinal side panels 26. Again, as in FIGS. 1, 2 and 4, the embodiment of FIG. 11 includes two pairs of extension panel member 46*a*, 46*b;* and a pair of transverse side panels 28.

One of ordinary skill in the art will understand that, in the crib configuration, the crib mattress support board 24, the pair of longitudinal side panels 26 and the pair of transverse side panels 28 which may be constructed from the common and crib components 64 and 66 of the kit 62, are perpendicularly removably attachable one to another so as to define a crib frame 30 of the crib 20, as described above with reference to the embodiment of FIG. 1. Preferably, in the crib configuration, each one of the pair of leg members 56 from the common components 64, may be removably attached to a bottom portion of the main panel member 44 of a corresponding one of the pair of longitudinal side panels 26, so as to extend downwardly therefrom and provide support for the crib 20 on a floor surface.

One of ordinary skill in the art will also readily understand that, in other embodiments, the crib components 66 may include various other structural, ornamental or connecting components without departing from the present invention. For example, as mentioned above and illustrated in FIG. 11, the crib components 66 of the kit 62 may preferably include one or more connecting members 38*a*, 38*b* adapted to removably connect the pair of longitudinal side panels 26 and or the pair of transverse side panels 28, such that upon attachment thereof, each connecting member is adapted for receiving and supporting the crib mattress support board 24. The crib components 66 may also include corner support elements 40*a* to 40*d* removably attachable at corresponding corners of the crib frame 30 and adapted to receive the crib mattress support board 24 and to maintain the same at an elevated position relative to a bottom portion of the crib frame 30.

The kit 62 also includes bed components 68, that is, components which are used only when the kit 62 is used in the bed configuration. In the illustrated embodiment, the bed components 68 include a pair of elongated members 70 removably attachable to the pair of leg members 56 for forming four sides of a substantially rectangular bed frame 60 of the bed 22 such as shown in FIG. 5.

One of ordinary skill in the art will understand that, in the bed configuration, the pair of elongated members 70 are adapted for serving as a pair of lengthwise sides of the bed frame 60, such that the length of the elongated members 70 corresponds substantially to the length of the bed 22. On the other hand, the pair of leg members 56 are adapted for serving as headboard and footboard sides 58*a*, 58*b* of the bed frame 60, each of the headboard and footboard sides 58*a*, 58*b* having a width substantially equal to the length of each leg member 56, the length of the headboard and footboard sides 58*a*, 58*b* thus corresponding substantially to the width of the bed 22.

Furthermore, it will be understood that the main support member 34 is attachable to the headboard side 58*a* of the bed frame for forming a headboard 42 of the bed 22 having a width substantially equal to the length of the main support member 34. In addition, each of the main panel members 44 is attachable at opposite sides thereof to the pair of elongated members 70 for forming a corresponding one of a pair of bed mattress support members 54. Each bed mattress support member 54 thus formed therefore has a width substantially equal to the length of the corresponding main panel member 44.

One of ordinary skill in the art will readily understand that, in other embodiments, the crib components 66 may include various other structural, ornamental or connecting components without departing from the present invention. For example, in one embodiment, the bed components 68 may further included at least one bed mattress extension member 72*a*, 72*b*, wherein, in the bed configuration, each bed mattress extension member 72*a*, 72*b* is removably attachable at opposite sides thereof to the pair of elongated members 70 for forming, along with the pair of bed mattress support members 54, a bed mattress support board 74. It will be understood that the bed mattress support board 74 of the bed 22 may be used to receive and support a bed mattress (not shown) upon which a person may rest or sleep. For example, in one embodiment, the bed mattress support board 74 may have a length of about 76½ inches and a width of about 40½ inches, which is sized and shaped so as to snugly receive and support a conventional twin bed mattress of about 75 inches in length and about 39 inches in width.

In this regard, it will be appreciated, as illustrated in FIGS. 6 and 11, that each elongated member 70 preferably has an L-shaped cross-sectional profile, the profile including a first portion 76*a* oriented in a vertical plane of the bed 22 (i.e. along the height of the bed 22) and second portion 76*b* connected to a bottom edge of the first portion 76*a* and which extends inwardly and horizontally relative to the bed 22 when the same is assembled using the common and bed components 64 and 68 of the kit 62. It will be understood that the second portion 76*b* of the elongated member 72 may be used to receive and support elements forming the bed mattress support board 74 such as the bed mattress support members 54 and the bed mattress extension member 72*a*, 72*b* described above.

It will be understand that in some embodiments, the kit 62 including the common components 64, the crib components 66 and the bed components 68 may be packaged, sold and purchased together as a single kit. Alternatively, in other embodiments, the common components 64, the crib components 66 and the bed components 68 may be packaged, sold and purchased as two or three separate kits.

According to another aspect of the invention, there is provided a method of converting a crib to a bed, the crib having a length greater than a width of the bed. The method according to embodiments of the invention may be carried out with a crib 20 such as those described above with reference to the embodiments illustrated in FIGS. 1, 8A, 9A and 10A in order to form a bed 22 such as that shown in FIGS. 5, 8B, 9B and 10B.

With continuing reference to FIGS. 1 to 6 and 11, the method converting a crib 20 to a bed 22 first includes a step of separating from the crib 20 the main support member 34 of the crib mattress support board 24 and the main panel member 44 of each of the pair of longitudinal side panels 26. As will be understood by one skilled in the art, this step typically involve removing all the attachment hardware or fastening devices (such as screws 32 in the illustrated embodiment) connecting the main support member 34 and the main panel members 44 to the crib 20

In one embodiment, the step of separating may include the substeps of separating from one another the crib mattress support board 24, the pair of longitudinal side panels 26, and the pair of transverse side panels 28 (see, e.g., FIG. 2);

detaching each extension support member 36*a*, 36*b* from the main support member 34 of the crib mattress support board 24 (see, e.g., FIG. 3); and detaching each extension panel member 46*a*, 46*b* from the main panel member 44 of each of the pair of longitudinal side panels 26 (see, e.g., FIG. 4).

The method then includes a step of providing a step a bed frame 60 of the bed 22. In some embodiments, the bed frame 60 may be provided as a component made of parts which are not utilized to construct the crib 20. Alternatively, in other embodiments, some of the components forming the bed frame 60 may be crib components 66 which have to be disassembled, reconfigured, and reassembled with bed components 68 for forming the bed frame 60. For example, in the crib and bed embodiments 20 and 22 shown in FIGS. 1 to 6 and 11, the crib 20 preferably further includes a pair of crib leg members 56, each crib leg member 56 having a length less than the length of the crib 20 and being removably attached to a bottom portion of the main panel member 44 of a corresponding one of the pair of longitudinal side panels 26. In this exemplary embodiment, the step of separating further includes the substep of detaching each crib leg member 56 from the corresponding main panel member 44 prior to the step of providing, as illustrated in FIG. 4. Furthermore, in this embodiment, the step of providing includes the substeps of:

providing a pair of elongated members 70 such as described above and illustrated in FIGS. 5, 6 and 11; and attaching the pair of elongated members 70 to the pair of crib leg members 56 for forming four sides of the bed frame 60, such that the pair of elongated members 70 serve as a pair of lengthwise sides of the bed frame and the pair of crib leg members 56 serve as headboard and footboard sides 58*a*, 58*b* of the bed frame 60 and as beg leg members, as illustrated in FIGS. 5 and 6.

Referring back to FIGS. 1 to 6 and 11, the method according to embodiments of the invention further includes a step of mounting the previously removed main support member 34 of the crib mattress support board 24 on the bed frame 60 as a headboard 42 of the bed 22, preferably by using common fasteners such as screws, as shown in FIG. 6.

Finally, the method includes a step of connecting each previously removed main panel member 44 of the longitudinal side panels 26 to the bed frame 60 as a bed mattress support member 54 of a bed mattress support board 74 of the bed 22, preferably also by using common fasteners such as screws, as shown in FIG. 6.

It will be understood by one of ordinary skill in the art that when one desire to reconvert the bed 22 to the crib 20, the steps described above may be reversed.

While this invention has been particularly shown and described with references to preferred embodiments thereof, it will be understood by one of ordinary skill in the art that various changes in form and details may be made therein without departing from the scope of the invention encompassed by the appended claims. In particular, dimensions are not intended to be limiting and may be altered as would be understood by one of ordinary skill in the art.

The invention claimed is:

1. A crib convertible to a bed, the crib having a length greater than a width of the bed, the crib comprising:

a crib mattress support board, the crib mattress support board including a main support member having a length less than the length of the crib, and at least one extension support member being removably attached to the main support member;

a pair of oppositely-facing longitudinal side panels, each including a main panel member having a length less than the length of the crib, and at least one extension panel member being removably attached to the main panel member;

a pair of oppositely-facing transverse side panels;

the crib mattress support board, the pair of longitudinal side panels and the pair of transverse side panels being perpendicularly removably attached one to another so as to define a crib frame of the crib;

wherein the main support member of the crib mattress support board is convertible, upon detachment of each extension support member therefrom, to a headboard of the bed, the headboard of the bed having a width substantially equal to the length of the main support member, and wherein the main panel member of each of the pair of longitudinal side panels is convertible, upon detachment of each respective extension panel member therefrom, to a corresponding one of a pair of bed mattress support members disposable along a lengthwise direction of the bed, each bed mattress support member having a width substantially equal to the length of the corresponding main panel member.

2. The crib according to claim 1, further comprising at least one connecting member extending between and removably connecting one of the pair of longitudinal side panels and the pair of transverse side panels, each connecting member being adapted for receiving and supporting the crib mattress support board.

3. The crib according to claim 2, wherein the at least one connecting member comprises two spaced-apart connecting members extending along a widthwise direction of the crib and removably connecting the pair of longitudinal side panels.

4. The crib according to claim 1, further comprising a pair of spaced-apart crib leg members removably attached to and downwardly extending from a bottom portion of the crib frame, each crib leg member having a length less than the length of the crib and being convertible, upon detachment from the crib frame, to a corresponding pair of bed leg members adapted for serving as headboard and footboard sides of a bed frame of the bed.

5. The crib according to claim 4, wherein each one of the pair of crib leg members extends along a lengthwise direction of the crib and is removably attached to a bottom portion of the main panel member of a corresponding one of the pair of longitudinal side panels.

6. The crib according to claim 1, wherein the main panel member of each of the pair of longitudinal side panels comprises a horizontal top portion, an opposite horizontal bottom portion, and a plurality of vertical rungs extending vertically between the top and bottom portions.

7. The crib according to claim 1, wherein the at least one extension support member of the crib mattress support board comprises a first and a second extension support member removably attached to opposite sides of the main support member such that the crib mattress support board extends along a lengthwise direction of the crib in the order of the first extension support member, the main support member, and the second extension support member.

8. The crib according to claim 1, wherein the at least one extension panel member of each one of the pair of longitudinal side panels comprises a first and a second extension panel member removably attached to opposite sides of the corresponding main panel member such that each one of the pair of longitudinal side panels extends along a lengthwise direction of the crib in the order of the first extension panel member, the main panel member, and the second extension panel member.

9. The crib according to claim 1, further comprising four corner support elements removably attached to the crib frame at four corresponding corners thereof, the four corner support elements being adapted to receive the crib mattress support board and maintain the same at an elevated position relative to a bottom surface of the crib frame.

10. The crib according to claim 1, wherein the crib has a length of about 53½ inches and is convertible into a bed having a width of about 40½ inches.

11. A kit for forming one of a crib and a bed, the crib having a length greater than a width of the bed, the kit comprising:

common components comprising:

a main support member;

a pair of main panel members; and a pair of leg members, the main support member, the pair of main panel members and the pair of leg members each having a length which is less than the length of the crib and substantially equal to the width of the bed;

crib components comprising:

at least one extension support member removably attachable to the main support member for forming, upon attachment therewith, a crib mattress support board;

a pair of at least one extension panel member, each at least one extension panel member being removably attachable to a corresponding one of the pair of main panel members for forming, upon attachment therewith, a corresponding pair of longitudinal side panels; and a pair of transverse side panels, and bed components comprising a pair of elongated members removably attachable to the pair of leg members for forming four sides of a bed frame of the bed;

wherein, in a crib configuration, the crib mattress support board, the pair of longitudinal side panels and the pair of transverse side panels are perpendicularly removably attachable one to another so as to define a crib frame of the crib, and wherein, in a bed configuration:

the pair of elongated members are adapted for serving as a pair of lengthwise sides of the bed frame and the pair of leg members are adapted for serving as headboard and footboard sides of the bed frame, each of the headboard and footboard sides having a width substantially equal to the length of each leg member;

the main support member is attachable to the headboard side of the bed frame for forming a headboard of the bed having a width substantially equal to the length of the main support member; and each of the main panel members is attachable at opposite sides thereof to the pair of elongated members for forming a corresponding one of a pair of bed mattress support members, each bed mattress support member having a width substantially equal to the length of the corresponding main panel member.

12. The kit according to claim 11, wherein, in the crib configuration, each one of the pair of leg members is removably attachable to a bottom portion of the main panel member of a corresponding one of the pair of longitudinal side panels.

13. The kit according to claim 11, wherein the bed components further comprise at least one bed mattress extension member, wherein, in the bed configuration, each bed mattress extension member is removably attachable at opposite sides thereof to the pair of elongated members for forming, along with the pair of bed mattress support members, a bed mattress support board.

14. A kit for forming a crib convertible to a bed, the crib having a length greater than a width of the bed, the kit comprising:

a main support member;

a pair of main panel members;

a pair of leg members, the main support member, the pair of main panel members and the pair of leg members each having a length which is less than the length of the crib and substantially equal to the width of the bed;

at least one extension support member removably attachable to the main support member for forming, upon attachment therewith, a crib mattress support board;

a pair of at least one extension panel member, each at least one extension panel member being removably attachable to a corresponding one of the pair of main panel members for forming, upon attachment therewith, a corresponding pair of longitudinal side panels; and a pair of transverse side panels;

wherein, in a crib configuration, the crib mattress support board, the pair of longitudinal side panels and the pair of transverse side panels are perpendicularly removably attachable one to another so as to define a crib frame of the crib; and wherein, in a bed configuration, and with an addition of bed components comprising a pair of elongated members removably attachable to the pair of leg members for forming four sides of a bed frame of the bed:

the pair of elongated members are adapted for serving as a pair of lengthwise sides of the bed frame and the pair of leg members are adapted for serving as headboard and footboard sides of the bed frame, each of the headboard and footboard sides having a width substantially equal to the length of each leg member;

the main support member is attachable to the headboard side of the bed frame for forming a headboard of the bed having a width substantially equal to the length of the main support member; and each of the main panel members is attachable at opposite sides thereof to the pair of elongated members for forming a corresponding one of a pair of bed mattress support members, each bed mattress support member having a width substantially equal to the length of the corresponding main panel member.

15. The kit according to claim 14, wherein, in the crib configuration, each one of the pair of leg members is removably attachable to a bottom portion of the main panel member of a corresponding one of the pair of longitudinal side panels.

16. A method of converting a crib to a bed, the crib having a length greater than a width of the bed, the crib including a crib mattress support board having a main support member with a length less than the length of the crib, and at least one extension support member being removably attached to the main support member; a pair of oppositely-facing longitudinal side panels, each having a main panel member with a length less than the length of the crib, and at least one extension panel member being removably attached to the main panel member; and a pair of oppositely-facing transverse side panels, the crib mattress support board, the pair of longitudinal side panels and the pair of transverse side panels being perpendicularly removably attached one to another so as to define a crib frame of the crib, wherein the main support member of the crib mattress support board is convertible, upon detachment of each extension support member therefrom, to a headboard of the bed, the headboard of the bed having a width substantially equal to the length of the main support member, and wherein the main panel member of each of the pair of longitudinal side panels is convertible, upon detachment of each respective extension panel member therefrom, to a corresponding one of a pair of bed mattress support members disposable along a lengthwise direction of the bed, each bed mattress support having a width substantially equal to the length of the corresponding main panel member, the method of converting the crib to a bed comprising the steps of:

separating from the crib the main support member of the crib mattress support board and the main panel member of each of the pair of longitudinal side panels;

providing a bed frame of the bed;

mounting the main support member on the bed frame as a headboard of the bed; and connecting each main panel member to the bed frame as one of a pair of bed mattress support members of a bed mattress support board of the bed.

17. The method according to claim 16, wherein the step of separating comprises the substeps of:

separating from one another the crib mattress support board, the pair of longitudinal side panels, and the pair of transverse side panels;

detaching each extension support member from the main support member of the crib mattress support board; and detaching each extension panel member from the main panel member of each of the pair of longitudinal side panels.

18. The method according to claim 17, wherein the crib further comprises a pair of crib leg members, each crib leg member having a length less than the length of the crib and being removably attached to a bottom portion of the main panel member of a corresponding one of the pair of longitudinal side panels, the step of separating further comprises the substep of:

detaching each crib leg member from the corresponding main panel member prior to the step of providing;

and the step of providing comprises the substeps of:

providing a pair of elongated members; and attaching the pair of elongated members to the pair of crib leg members for forming four sides of the bed frame, such that the pair of elongated members serve as a pair of lengthwise sides of the bed frame and the pair of crib leg members serve as headboard and footboard sides of the bed frame and as beg leg members.

* * * * *